United States Patent [19]

Salzer

[11] Patent Number: 4,854,248

[45] Date of Patent: Aug. 8, 1989

[54] BLAST RESISTANT COMPOSITE FRAMING SECTION

[76] Inventor: Heinrich Salzer, Industriestrabe 4, 3550 Marburg,Wehrda, Fed. Rep. of Germany

[21] Appl. No.: 199,207

[22] Filed: May 26, 1988

[30] Foreign Application Priority Data

Jun. 6, 1987 [DE] Fed. Rep. of Germany ..... 3719117

[51] Int. Cl.[4] ..... E04B 2/02

[52] U.S. Cl. ..... 109/79; 109/49.5; 52/463; 49/DIG. 1

[58] Field of Search ..... 109/49.5, 78, 79; 52/475, 463, 584, 772; 49/DIG. 1

[56] References Cited

U.S. PATENT DOCUMENTS 4,543,756 10/1985 Kamiwaga et al. ..... 49/DIG. 1
4,563,848 1/1986 Gartner ..... 49/DIG. 1
4,625,659 12/1986 Saelzer ..... 109/49.5

*Primary Examiner*—Neill R. Wilson
*Attorney, Agent, or Firm*—Arthur B. Colvin

[57] ABSTRACT

For framing plate type panels a composite section is used which is fitted together from a center part (3) and two lateral parts (4,5). The stay type center part (3) has two stay segments (6,7) which are spaced from each other and connected together through a pair of insulating strips 8. On the side away from the respective panels (1,2) the two lateral parts (4,5) are provided with reinforcement sections (10). Threaded studs (12) distributed at intervals over the length of the composite section connect the reinforcement sections (10) and hence the section parts disposed therebetween with one another. This results in a stable union of the composite section, which not only is given a bombardment-inhibiting effect by the reinforcement sections (10), but also is able to withstand high tensile stresses of the center part (3) and to prevent deformations of the lateral parts (4,5).

5 Claims, 1 Drawing Sheet

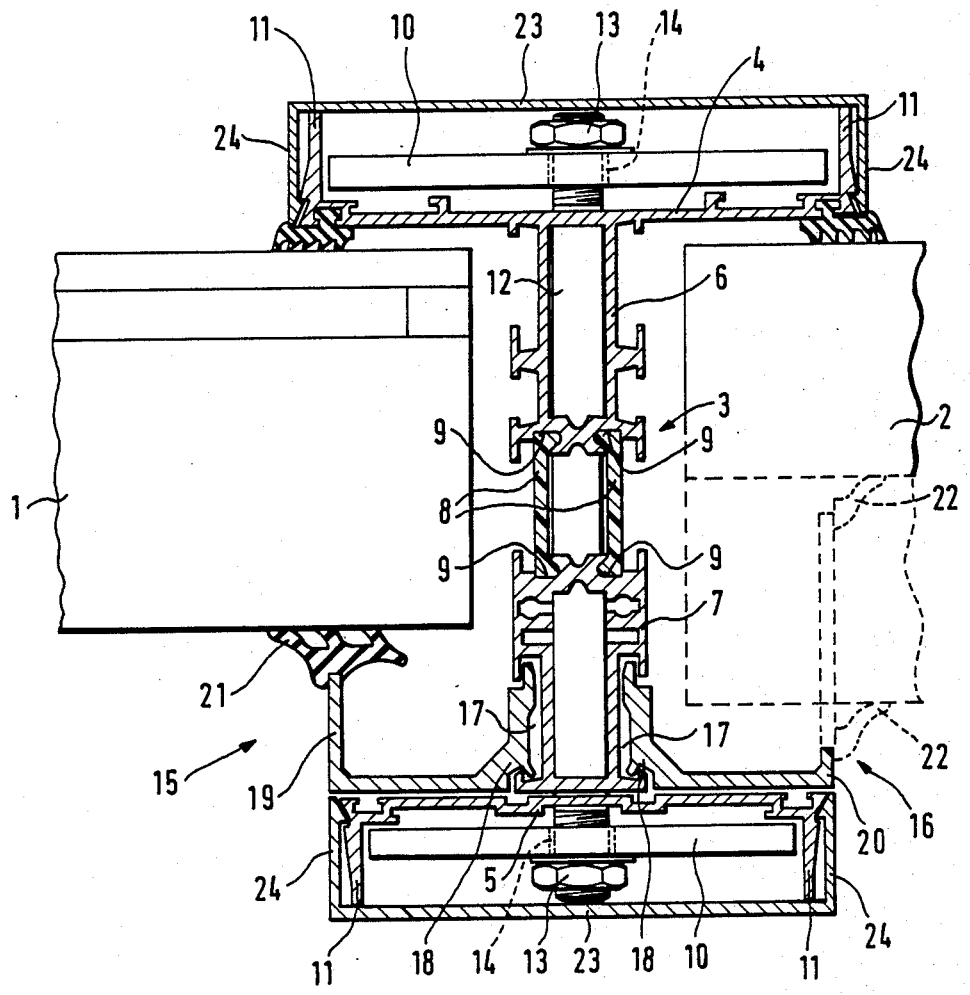
11
10
23
13
14
4
24
11
24
12
6
3
2
9
9
1
8
22
9
9
7
21
17
17
22
15
19
20
16
24
5
24
11
18
14
13
23
18
10
11

BLAST RESISTANT COMPOSITE FRAMING SECTION

BACKGROUND OF THE INVENTION

1. FIELD OF THE INVENTION

This invention is in the field of blast resistant framing structure and more particularly relates to a laminate or composite section for framing plate type panels.

2. PRIOR ART

Composite sections are known from Hartmam Profilkatalog 1986, in particular sheets 406 and 416. Between a pair of stay segments integral with respective lateral parts there is arranged a unitary strip of heat insulation material which embraces the end zones of the stay segment facing each other. Screws distributed at intervals over the length of the section pass through the lateral part from which they start and through the stay segment connected thereto, all the way, extending through bores disposed between the strips and into threaded bores in the opposite stay segment. In the known composite sections, fitted together substantially in double-T arrangement, one lateral part has a U-shaped cover section such that thereby a chamber is formed which extends over edge strips of the panels disposed on either side of the stay. Despite the screw heads positioned inside the chamber, a cavity remains in the chamber for accommodating therein reinforcements enclosed by the cover section and by the lateral part.

However, the known composite sections cannot be manufactured in a design sufficiently resistant to bombardment and explosive impacts. Under such stressed, pressure waves occur as a rule which stress the panels in alternating directions so that considerable tensile forces occur at the stay of the laminate section. The screw unions provided for holding the section parts together are insufficient for safe absorption of these forces. But even if the screws were strong engough to absorb the anticipated forces, there would be danger that a flange type lateral part would warp under the pressure of the panel and the panel would thereby lose its skirting frame. Therefore, the generally adopted arrangement of reinforcements in the chambers of such section combinations can, by itself, not help to improve the union of the section parts.

It is the object of the invention to provide a composite section for framing plate type panels wherein both a stable and sturdy union of the section parts under load in alternating or simultaneously in opposite directions as well as their deformationless force absorption is ensured.

SUMMARY OF THE INVENTION

To solve this problem there is provided a section including opposed central stays having a pair of insulating composite strips disposed therebetween and outwardly open, U-shaped panel embracing parts at the outer ends of the stays. Reinforcement sections are disposed within the U-shaped parts and are joined by threaded studs.

The fact, according to the invention, that the reinforcement sections are tranversed by the screw studs extends the covering function of the reinforcement sections to a pressing function, which benefits the stable union of all section parts, and to an additional supporting function for the lateral parts subject to bending stress. Depending on the clamping action of the threaded studs, each of which is provided with a nut for example at both ends, the reinforcements sections are pressed against the lateral parts, which in turn press the stay segments with the insulating strip pair disposed therebetween against each other with the same force.

Depending on its particular purpose of use, the new composite section may be composed of a hollow stay with differently formed and variously arranged lateral parts. Thus, the laminate section may be double T-shaped to form a stave or U-shaped or angular to form a false or casement member. In any case, however, the lateral parts are pressed by the studs against the center part having the form of a hollow stay, through the reinforcement sections adapted to the lateral parts.

According to a development of the invention, a plate type panel with frame members formed from the laminate section can be framed securely if at least one lateral part of the U-shaped parts is wider than the thickness of the stay sections forming the center part and protrudes over the latter on at least one side.

The plate type panel can then be framed so that one leg of the section combination, which in the simplest case is angular, covers the edge region of the panel on a side exposed to the dange of attack or aggression.

For a stable and sturdy union between the strip pair disposed in the center of the stay and the contiguous stay segments, a further development of the invention provides that the edge strips of the strip pair are pressed into opposed end grooves formed in the two stay segments.

Without the threaded studs and reinforcements, according to the invention, the edge strips of the insulating strip pair, pressed into the end grooved of the stay segments, would be ripped out of the grooves under even a relatively slight tensile stress and the composite section would burst. In the case of an impact, considerable tensile stressed act on the stay, so that the threaded studs and reinforcements according to the invention, completely eliminate the need for the otherwise required costly use of other clamping means which, given the composite nature of the frame, could hardly be accommodated.

According to a further development of the invention, at least one stay segment has on each of its opposite sides an undercut groove facing outwardly and extending lengthwise of the section, into which one leg of a U-shaped holding strip is insertable. Another leg of the holding strip parallels an outer surface of a retained panel and braces itself, with a stay connecting the legs, against a lateral part laterally projecting over the stay segment.

By the secure support of the lateral parts bracing against the reinforcements sections the lateral parts are also stabilized so that the U-shaped holding strip is given a rigid abutment against which it is braced to provide firm support for the panels. The leg which is under compressive stress only and opposing the edge strip of the panel can therefore transmit forces resulting from vibrations of the panel to the composite section without danger of deformation.

To minimize the number of section parts, it is advantageous if according to a further development of the invention at least one stay segment is in one piece with a lateral part.

Lastly, a development of the invention further provides that each lateral part has a U-shaped cross-section and can be covered by a U-shaped cap to define a closable chamber for accommodating reinforcement sections of different dimensions.

Owing to this design, for example, frames and staves of a partition or facade can be fitted together from composite sections of substantially identical design, and depending on different load capacity as may be required areawise, different reinforcement sections may be used without having to deviate from an outwardly uniform appearance.

BRIEF DESCRIPTION OF THE DRAWINGS

The single drawing FIGURE illustrates a laminate or composite section according to the invention to transverse section.

DETAILED DESCRIPTION OF THE DRAWINGS

The composite section, formed for example, as a stave and disposed between two adjacent plate type panels 1 and 2, consists of a stay type center part 3 and two contiguous, substantially U-shaped lateral parts 4 and 5. Due to the double-T arrangement shown in the illustrated embodiment example, the center part 3 forms a stay whose central axis coincides with that of the composite section, while the lateral parts 4 and 5 each form a flange perpendicular thereto.

The center part 3 is formed of two stay segment 6, 7 and a pair of strips 8 disposed therebetween. The stay segment 6 in the illustrated embodiment is in one piece with the lateral part 4 but these parts may be separate elements. The strip pair 8 consists of relatively rigid insulating material, which in particular is able to absorb kinetic energy imparted to the center part 3 under elastic deformation. Edge portions of the strip pair 8 are pressed into end grooves 9 of the stay segments 6 and 7.

On the side of the lateral parts 4 and 5 away from the respective panels 1 and 2, (the outside) the lateral parts 4 and 5 are each associated with a reinforcement section 10, which substantially extends over the free space between angularly bent legs 11 of the lateral parts 4 and 5.

The reinforcement sections 10 are held together by threaded studs 12, on the ends of which nuts 13 are mounted. To this end the studs 12 are distributed over the length of the laminate section at regular intervals, and pass through bores 14 in the reinforcements sections 10 as well as through hollow stay segments 6 and 7, being at most tangential to the inner opposed faces of the strip pair 8. As a result of the clamping action of the screw studs 12, the section parts disposed between the reinforcement sections 10 are held firmly together.

These section parts include U-shaped panel holding strips 15, 16, which are embedded by one leg in undercut grooves 17 integrally formed laterally of the stay segment 7. By an additional leg 19 or 20 which can be adapted lengthwise to the respective thickness of the panels 1 and 2, the U-shaped holding strips 15, 16 press elastic seal strips 21, 22 against the panels 1 and 3, respectively. The other surface of holding strips 15, 16 are firmly braced against inwardly facing portions of lateral part 5.

Lastly, the U-shaped lateral parts 4 and 5 are provided with caps 23, also U-shaped, which can be clipped or snap fitted onto the legs 11 of the lateral parts 4 and 5 with legs 24, thereby covering the reinforcement section 10 to be supplemented as needed or to be exchanged for others.

From the foregoing description it will be perceived that there is provided, in accordance with the invention, a blast resistant frame section for encompassing panels which is readily adaptable to panels for a variety of thickness. By changing the dimensions of the reinforcing sections 10, the section may be tailored to panels of various characteristics while still maintaining, from the exterior, a uniform appearance.

I claim:

1. An elongated blast resistant composite section for framing planar panels comprising a spaced pair of hollow stay segments having opposed aligned pockets, a spaced pair of insulator members spanning said pockets, a U-shaped part having a central web and outwardly directed legs at the end of each said stay remote from said pocket, a reinforcement member disposed between the legs of each of said U-shaped parts, and threaded stud members extending between said reinforcement members and passing through said webs, said stays and between said insulator members, to thereby compress said reinforcement members against said webs and said stays against said insulator members.

2. A composite section in accordance with claim 1 wherein said webs of said U-shaped extend laterally to either side of said stays.

3. A composite section in accordance with claim 2 wherein at least one of said stay segments includes an undercut groove extending lengthwise of said segment, and opening toward the web of the U-shaped part associated with said one stay and a holding strip having a first leg disposed in said groove and a second leg braced against said web.

4. A composite section in accordance with claim 2 wherein at least one said U-shaped part is integral with a said stay.

5. A composite section in accordance with claim 3 and including a U-shaped cover section encompassing the legs of a said U-shaped part to define a closed chamber between said cover section and U-shaped part wherein said reinforcement members are encompassed.

* * * * *